US010417860B2

(12) United States Patent
Lewis et al.

(10) Patent No.: US 10,417,860 B2
(45) Date of Patent: Sep. 17, 2019

(54) MOUNTING CONFIGURATION AND METHOD FOR A TOPPER DISPLAY OF A GAMING MACHINE

(71) Applicant: AGS LLC, Las Vegas, NV (US)

(72) Inventors: Rachel Calhoun Lewis, Atlanta, GA (US); James Ely Tillery, Atlanta, GA (US)

(73) Assignee: AGS LLC, Las Vegas, NV (US)

( * ) Notice: Subject to any disclaimer, the term of this patent is extended or adjusted under 35 U.S.C. 154(b) by 0 days.

(21) Appl. No.: 15/718,250

(22) Filed: Sep. 28, 2017

(65) Prior Publication Data

US 2019/0096170 A1 Mar. 28, 2019

(51) Int. Cl.
*G07F 17/32* (2006.01)

(52) U.S. Cl.
CPC ..... *G07F 17/3216* (2013.01); *G07F 17/3209* (2013.01); *G07F 17/3211* (2013.01); *G07F 17/3244* (2013.01)

(58) Field of Classification Search
None
See application file for complete search history.

(56) References Cited

U.S. PATENT DOCUMENTS 6,315,666 B1 11/2001 Mastera et al.
2007/0287528 A1* 12/2007 Hirato ..... G07F 17/32 463/20
2009/0253499 A1* 10/2009 Nagano ..... G07F 17/3211 463/30

OTHER PUBLICATIONS

Aristocrat Technologies Australia Pty Limited, Helix Brochure, Copyright 2016, 6 pages.

* cited by examiner

*Primary Examiner* — Damon J Pierce
(74) *Attorney, Agent, or Firm* — Weide & Miller, Ltd.

(57) ABSTRACT

A gaming machine has a cabinet, one or more first displays, and a topper mount which supports a topper display above the cabinet and the first display(s). The topper mount may comprise a tower which extends upwardly from the cabinet and arms which extend upwardly from the tower to support the topper display. The topper mount extends behind the topper display while supporting the topper display outwardly in alignment with the first display(s) and directly adjacent to the first display(s). The topper mount may define an internal cable routing path from the topper display into the cabinet.

13 Claims, 8 Drawing Sheets

MOUNTING CONFIGURATION AND METHOD FOR A TOPPER DISPLAY OF A GAMING MACHINE

FIELD OF THE INVENTION

The present invention relates to gaming machines having electronic video displays and methods of mounting those displays.

BACKGROUND OF THE INVENTION

Wager-based gaming machines have become increasingly complex. Originally, mechanical slot machines had metal cabinets which housed a plurality of spinning physical reels which displayed game symbols. The symbols were viewable through windows in a front of the gaming machine.

Much later, video gaming machines were developed, such as video poker and video slot machines. These gaming machines had a cabinet which housed a large CRT display. The CRT was supported on a shelf in the cabinet and was viewable through a glass covered opening in the front of the gaming machine.

CRT displays were later replaced with thinner and lighter LCD and similar displays. This allowed the displays to be mounted to the cabinet in other ways, such as to a front door of the cabinet.

Gaming machines continue to evolve, both relative to their method of manufacture and their aesthetic appearance. For example, gaming machines are often modular now and may include a base unit with a single main video display. The base unit may be configured to be expanded, such as to include one or more secondary displays, such as positioned at or above the top of the base gaming machine.

For example, U.S. Pat. No. 6,315,666 discloses a gaming machine (210) having a base housing (212) which supports a main display (22). The gaming machine also includes a secondary display (219). As illustrated in FIG. 3*a* of that patent, the secondary display (219) may be housed inside a large generally hollow top box (301) which is designed to sit on the top of the base housing (212) of the gaming machine (210).

In this configuration, an entirely separate box or enclosure is provided for the secondary display, where the display is disposed inside of that box and then the box sits on top of the base housing. However, such a configuration has a number of drawbacks and disadvantages. First, the top box is bulky and causes the gaming machine to have a large and bulky appearance, rather than a streamlined and futuristic appearance. Also, the secondary display is supported in the top box and is thus separated from the main display physically. Thus, the secondary display can't provide a relatively contiguous presentation of the information with the main display because the user of the gaming machine has to constantly shift their focus between the two displays because they are so far apart.

An improved gaming machine secondary or topper display mounting configuration is desired.

SUMMARY OF THE INVENTION

Embodiments of the invention comprise mounting configurations and methods for a topper display of a gaming machine.

In one embodiment, a gaming machine has a base or main cabinet. At least one first or main display, such as a first or a first and a second display, is supported by the cabinet. The at least one first display may comprise a video display or other display device such as a set of spinning reels. The at least one first display may be mounted to a door of the cabinet.

In accordance with the invention the gaming machine includes a topper display, such as a topper video display. In one embodiment of the invention, a topper display mount is provided for mounting or connecting the topper display to the gaming machine. In one embodiment, the topper display mount extends generally vertically upward from the gaming machine cabinet so as to support the topper display in an elevated position above the cabinet and the other displays. The topper display is configured to mount to the topper display mount so that it is positioned in front of the mount (whereby the topper display mount is then located behind the topper display at a back of the gaming machine wherein it is generally not visible). In one embodiment, this allows the topper display to be positioned in alignment with the front of the gaming machine and adjacent to the other displays, such as the first or second display, thus creating a generally seamless video environment to the player.

In one embodiment, the topper display mount has a lower portion comprising a tower and an upper portion comprising a pair of support arms. A bottom portion of the tower is connected to the gaming machine cabinet. A bottom portion of each arm is connected to a top portion of the tower. The arms extend upwardly to top portions thereof which support the topper display, which may be mounted to the arms via a mounting bracket. In one embodiment, the top portion of the arms extend at a 90-degree angle relative to the bottom portion of the arms, causing the topper display to be positioned outwardly of the mount towards the front of the gaming machine.

In another embodiment, the topper display mount only comprises an upper portion comprising a pair of support arms where the bottom portions of the support arms are directly connected to the gaming machine cabinet.

In one embodiment, the topper display mount defines an internal cable routing path for cables to be run from the topper display to the gaming machine cabinet. In one embodiment, this path comprises a cable routing path through one or both arms, such as where the arms each have a first trough-shaped portion which is covered by a cable cover to define an enclosed cable routing path. The path may also comprise a cable routing path through the tower, such as defined by the space between two side bracket portions thereof which leads to an opening in the top of the gaming machine cabinet. One or more cable routing access apertures may be provided, such as in the cable covers of the arms, to aid the user in routing the cables.

In one embodiment, the connection of the topper display to the mounting bracket which is supported by the arms is covered by a facia or cover. The arms may pass through a pair of openings or cut-outs in the facia. The cut-outs may accept arms of different sizes, where smaller arms include one or more tabs which fill in the space around the arms in the cut-outs.

In one embodiment, a facia or cover may also extend over the tower, thus enclosing or hiding it.

The topper display mount provides a stable, streamlined and aesthetically pleasing mount for a topper display, such as by supporting the topper display without a bulky housing. Also, the topper display mount supports the topper display in alignment with other displays of the gaming machine, preferably directly adjacent to such displays.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise a gaming machine topper display mounting configuration and method.

The principles of the invention may be applied to gaming machines having various configurations. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 1:
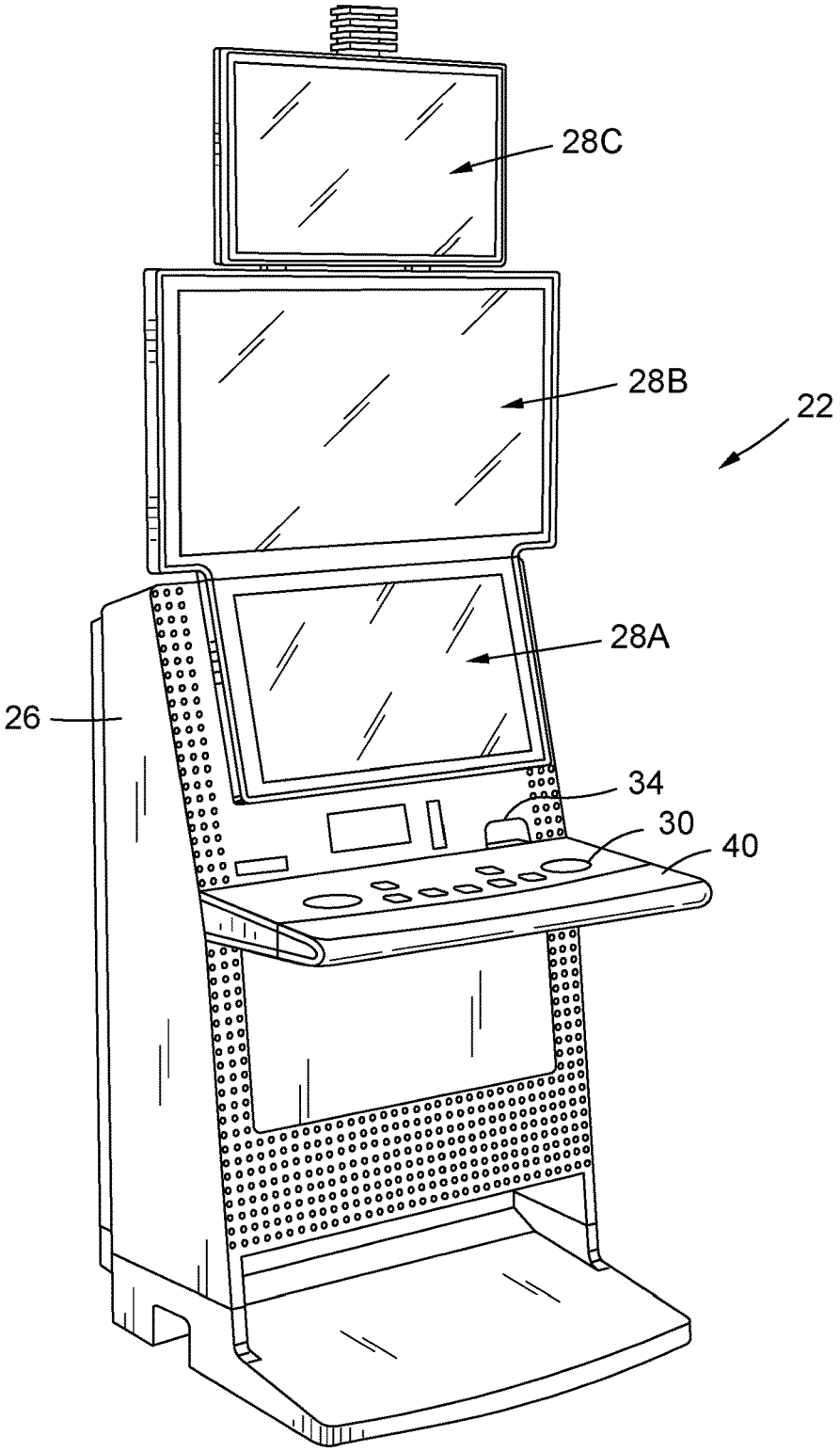
FIG. 1 illustrates one embodiment of a gaming machine in accordance with the invention.

One configuration of a gaming machine 22 of the invention is illustrated in FIG. 1. As illustrated, the gaming machine 22 generally comprises a housing or cabinet 26 for supporting and/or enclosing various components required for operation of the gaming machine. The cabinet 26 preferably includes one or more doors or other access panels or features which can be moved between an open position which allows access to one or more interior portions of the gaming machine, and a closed position in which access to the one or more interior portions is generally prevented. The doors may include locks or other features for securing them in their closed positions. The configuration of the gaming machine 22 may vary, such as having other shapes or dimensions.

The gaming machine 22 preferably includes at least one display device configured to display game information. The display device may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display device may be capable of projecting or displaying a wide variety of information, including images, symbols and other indicia or information associated with game play, game promotion or other events. The gaming machine 22 preferably includes more than one display device, such as two or more video displays which are associated with the cabinet 26. For example, the gaming machine 22 illustrated in FIG. 1 includes a main or first display 28A (such as a thin panel video display) which is located at a front of the cabinet 26, a secondary display 28B (such as another thin panel video display) which is positioned above the main display 28A and extends above a top portion of the cabinet 26, and a third or topper display 28C (such as yet another video display) which is positioned at the top of the gaming machine above the secondary display 28B. Also, while the first, second and third displays 28A,28B,28C are illustrated as generally rectangular video displays which are mounted in landscape position, the one or more displays might be mounted in other orientations, such as in portrait orientation or combinations of different positions. As noted below, the gaming machine 22 might include other numbers of displays, such a just a first display and a second topper display, or more than three displays. Also, while the displays are preferably video displays, it is possible for the displays to comprise other types of display devices, such as reel type devices (for example, the base or primary display might comprise a set of physical spinning reels and the other or additional displays might comprise video displays).

As described in more detail below, the gaming machine 22 is preferably configured to present one or more games upon a player making a monetary payment or wager. In this regard, as described in more detail below, the gaming machine 22 includes a mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to "cash out" of the gaming machine, or to provide various other inputs. As illustrated, a button deck 40 may extend outwardly from the front of the cabinet 26 towards the player. The button deck 40 may support, for example, one or more of the input devices 30, such as buttons, a touch screen or the like.

In one preferred embodiment, the gaming machine 22 includes at least one microprocessor or controller for controlling the gaming machine, including receiving player input and sending output signals for controlling the various components or peripheral devices of the machine 22 (such as generating game information for display by the displays 28A,28B,28C). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the display 28A,28B,28C, for determining winning or losing game outcomes and for displaying information regarding awards for winning game outcomes, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information). The gaming machine 22 may also include one or more random number generators for generating random numbers (such as implemented by a random number generator software module stored in the memory and executable by the processor or controller), such as for use in selecting game information and presenting the game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions (e.g. software) which are configured to implement the game. In this regard, the gaming machine is specially configured to present the game of the invention via specific software and/or hardware which causes the gaming machine to operate uniquely. For example, the controller of the gaming machine 22 may be configured to detect a wager, such as a signal from a player's depressing of the "bet one" button (such as one of the buttons 30). Upon such an event and/or the player otherwise signaling the gaming machine to present the game, the controller may be configured to cause the at least one display 28A,28B,28C to display unique information, such as a unique graphical interface or unique game display, including game symbols or other game information (such as graphically represented images of cards, slot symbols, dice, etc.). It is also noted that in some embodiments, some of the information might be provided to one or more of the displays externally (for example, first and second displays of the gaming machine might display base game and bonus game information provided by the controller, while the third display might display community game information, progressive jackpot information or the like which is provided by an external system such as a jackpot controller). The controller may accept input from a player of game inputs, such as a request to spin reels or the like, via the one or more player input devices of the gaming machine 22. As indicated above, the machine-readable code may be configured in various manners, such as by having various "modules" of software which are designed to implement specific features of the game play or game presentation.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). For example, the gaming machine 22 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, while not shown in FIG. 1, the gaming machine 22 might include a coin acceptor for accepting coins. Of course, associated coin reading/verifying devices and coin storage devices may be associated with the gaming machine 22 if it is configured to accept coins. Likewise, the gaming machine 22 might include a currency accepting device (not visible) having an acceptor slot or opening which is accessible through an access opening 34, such as in the front of the cabinet just above the button deck 40. As also described below, such a device may be configured to accept and read/verify paper currency and/or other media such as tickets (although the currency accepting device may be configured to accept and read not only currency, but tickets, media or elements other than currency, for ease of reference the device is referred to herein as a currency accepting device).

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button (such as implemented via one of the buttons 30) or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and associated keypad. Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIG. 1 is only exemplary of one embodiment of a gaming machine. For example, it is possible to for the gaming machine to have various other configurations, including different shapes and styles and having different components than as just described.

As noted, the gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

As noted above, in one embodiment the gaming machine 22 includes a first or main display 28A, a secondary display 28B, and a third or topper display 29C. In one embodiment of the invention, a topper display mount 200 is provided for mounting or connecting the topper display 28C to the gaming machine 22. In one embodiment, the topper display mount 200 extends generally vertically upward from the gaming machine cabinet 26 so as to support the topper display 29C in an elevated position, preferably above the other displays. As detailed below, in one embodiment, the topper display 29C is configured to mount to a front of the topper display mount 200 so that it is positioned in front of the mount (whereby the topper display mount 200 is then located behind the topper display 29C at the back of the gaming machine 22 wherein it is generally not visible). This allows, for example, the topper display 29C to be positioned in alignment with the front of the gaming machine and adjacent to the other displays, such as the second display 28B, thus creating a generally seamless video environment to the player (as best illustrated in FIG. 1).

Figure 2:
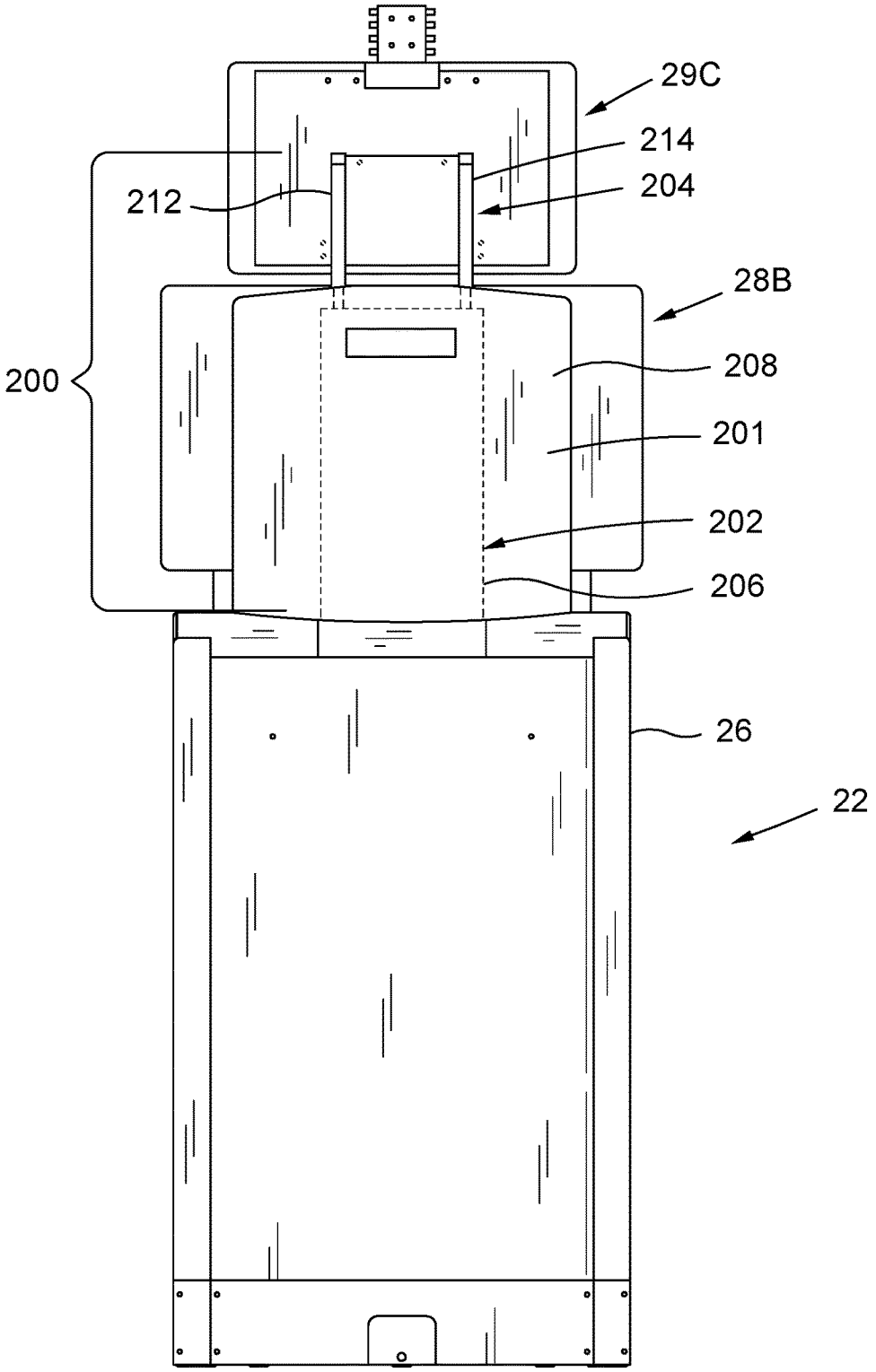
FIG. 2 illustrates a rear or back of the gaming machine illustrated in FIG. 1, including aspects of a topper display mount and base support in accordance with a first embodiment of the invention.

As illustrated in FIG. 2, the topper display mount 200 has a bottom portion 202 and an upper or top portion 204. In one embodiment, the bottom portion 202 comprises a base support or tower 206. The tower 206 has a bottom portion and a top portion, where the bottom portion is connected to the cabinet 26 of the gaming machine 22 and the tower extends upwardly generally vertically therefrom. As illustrated, the tower 206 may be located in or be covered by a cover or facia 210. The upper or top portion 204 of the topper display mount 200 may comprise at least one arm or strut, such as a first arm 212 and a second arm 214. As illustrated, the first and second arms 212,214 may extend upwardly from the top portion of the tower 206, and the third or topper display 28C may be mounted to those arms, as described in more detail below.

Figure 3:
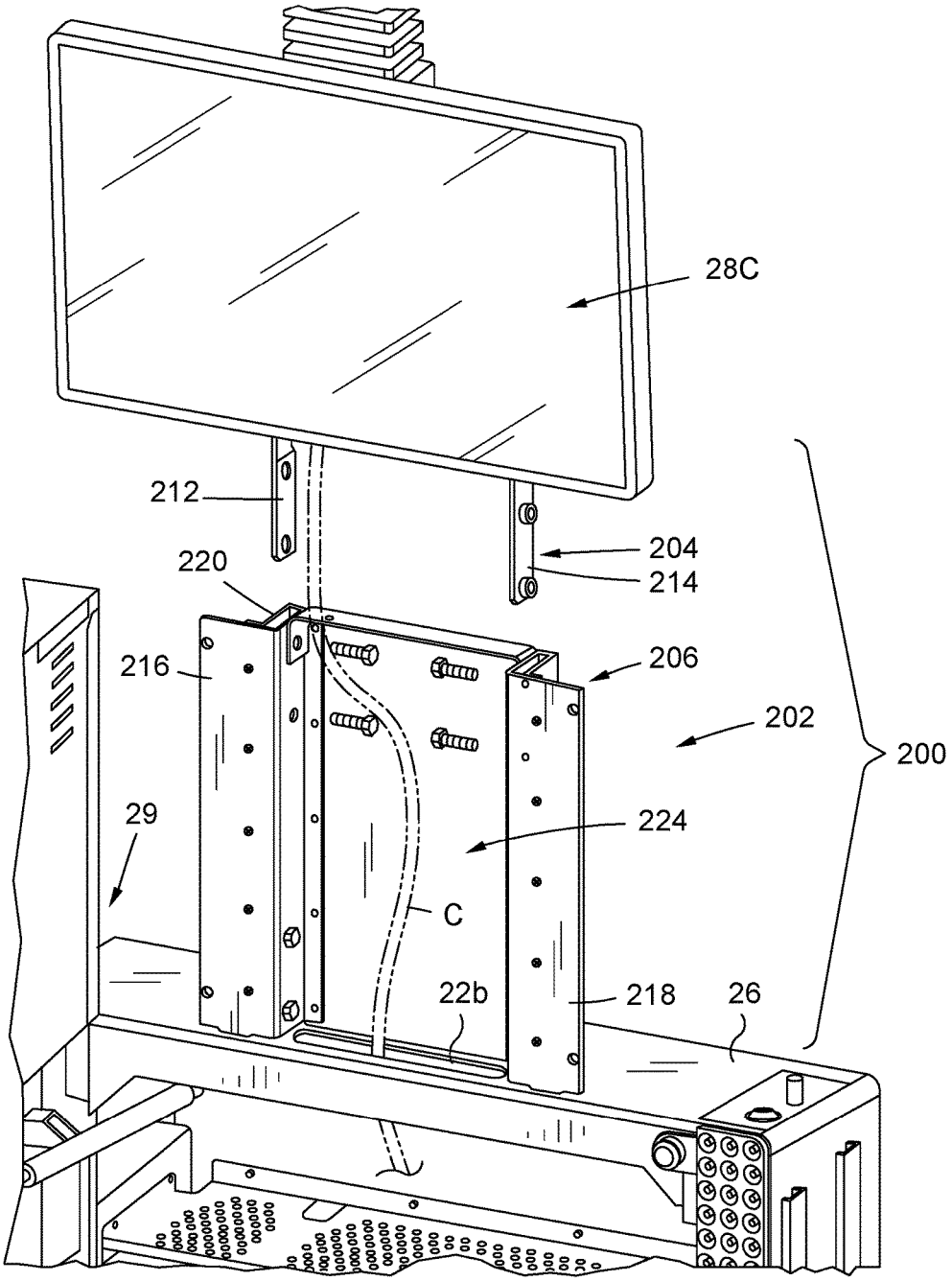
FIG. 3 is an exploded view of the topper display mount and the base support in accordance with the first embodiment of the invention.

As illustrated in FIG. 3, in this embodiment of the gaming machine 22, the first and second displays may be mounted directly to the gaming machine cabinet 26, such as a door 29 thereof so as to be moveable with the door. In other embodiments, the second display 28B may be mounted to the tower 206. The topper display mount 200 extends upwardly from the cabinet 26 so as to position the third or topper display 28C above the second display 28B (and, as described in more detail below, preferably in a position where a bottom of the topper display 28C is positioned in close proximity to, and in alignment with, the second display 28B).

Still referring to FIG. 3, in one embodiment, the tower 206 comprises a generally strong and rigid body and may thus be constructed from metal (such as formed from sheet metal or the like), or other suitable materials such as plastic, structural foam or the like. In one embodiment, the tower 206 includes first and second brackets 216,218, such as at opposing sides of a main portion of the tower 206. The first and second brackets 216,218 provide a mounting area for the arms 212,214 of the upper portion 204 of the topper display mount 200. In one embodiment, the first and second brackets 216,218 each define a generally vertically extending slot 220,222 for accepting a corresponding portion of one of the arms 212,214. The slots 220,222 may be dimensioned to closely accept the arms 212,214 therein so as to aid in maintaining the topper display 29C in a fixed position, as described in more detail below.

Figure 4:
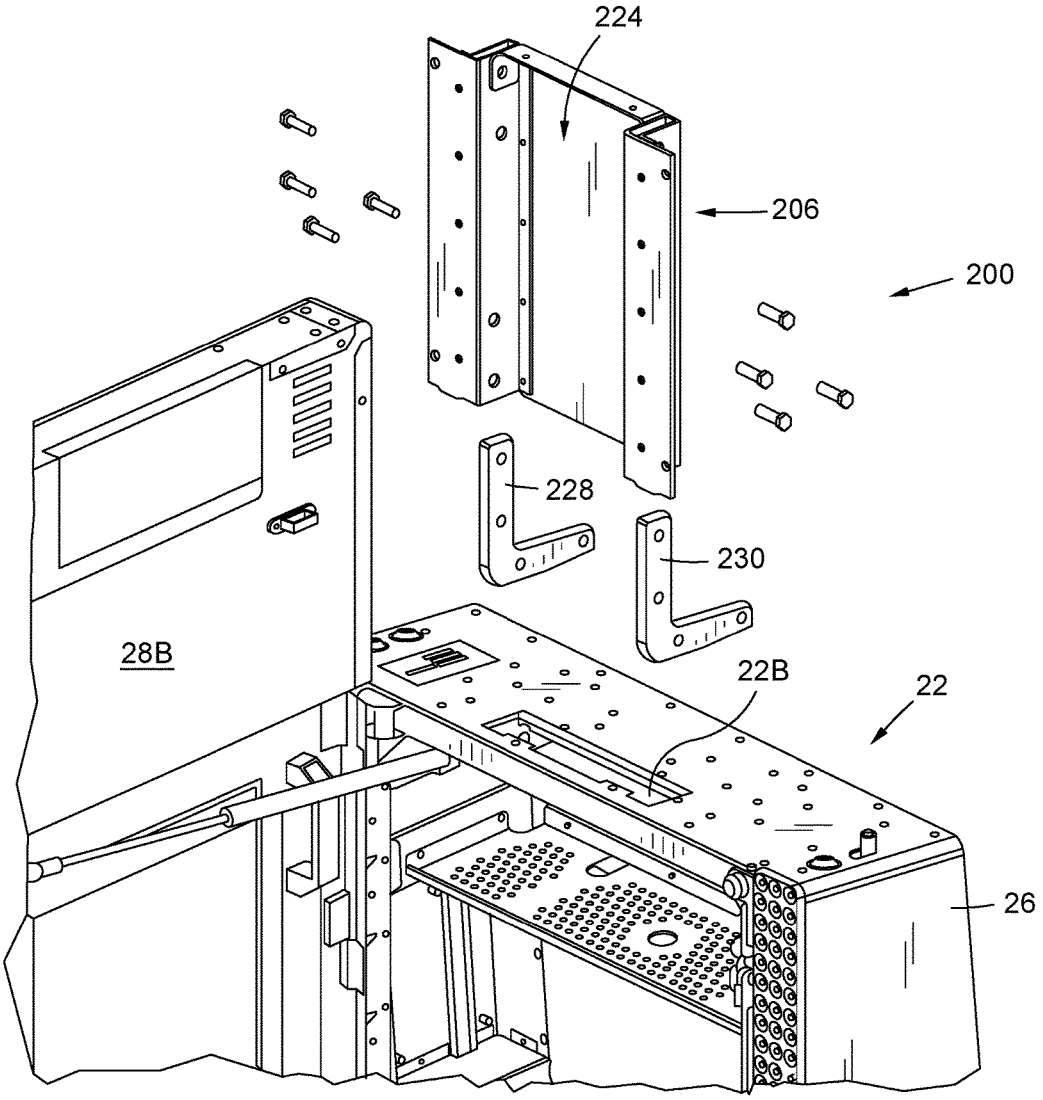
FIG. 4 illustrates additional details of the base support illustrated in FIG. 3.

Addition details of the bottom portion 202 of the topper display mount 200 are illustrated in FIG. 4. As illustrated, the tower 206, such as the bottom portion thereof, may be mounted to the gaming machine cabinet 26 by one or more mounts, such as first and second arms or brackets 228,230. The body of the tower 206 may be connected to a first portion of each bracket 228,230, such as via one or more threaded fasteners such as bolts, screws or the like. A second portion of each bracket 228,230 may then be connected to the cabinet 26, also via one or more threaded fasteners or the like. As illustrated, the brackets 228,230 might be generally "L" shaped, where the second portion extends horizontally within the cabinet 26 and then the first portion extends generally vertically upward through the opening 226 in the top of the cabinet 26 to the tower 206.

As best illustrated in FIG. 2, the entire tower 206 may be hidden within a facia or cover 208. This cover 208 may have various shapes and sizes and preferably mounts over the tower 206 to hide or enclose it. The cover 208 may be connected to the tower 206, the gaming machine cabinet 26 or the like.

Figure 5:
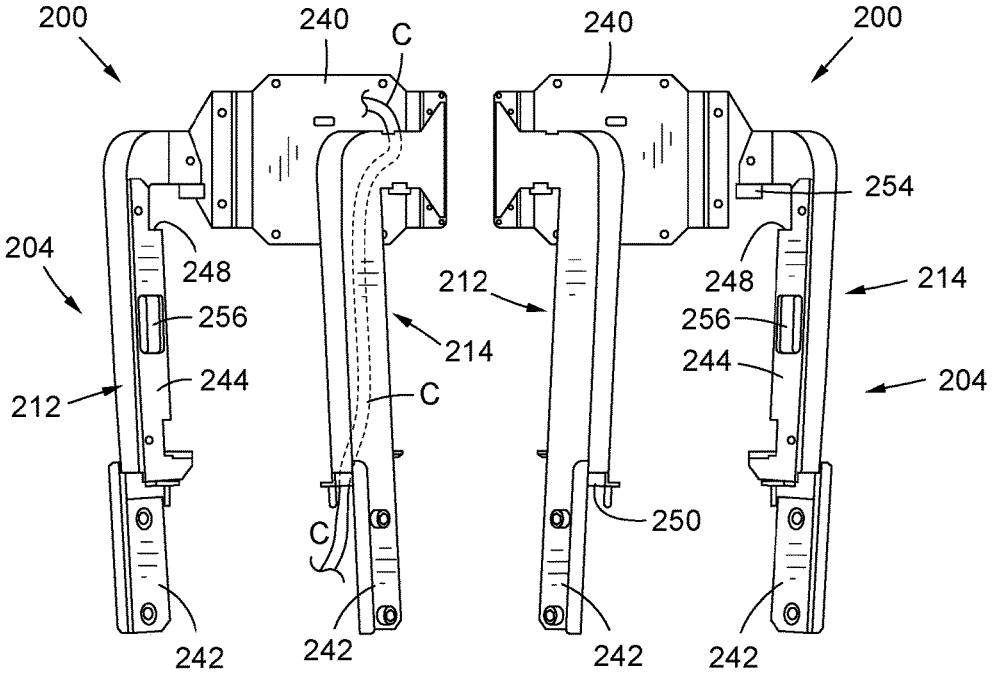
FIG. 5 illustrates aspects of a topper display mount in accordance with the first embodiment of the invention.
Figure 6:
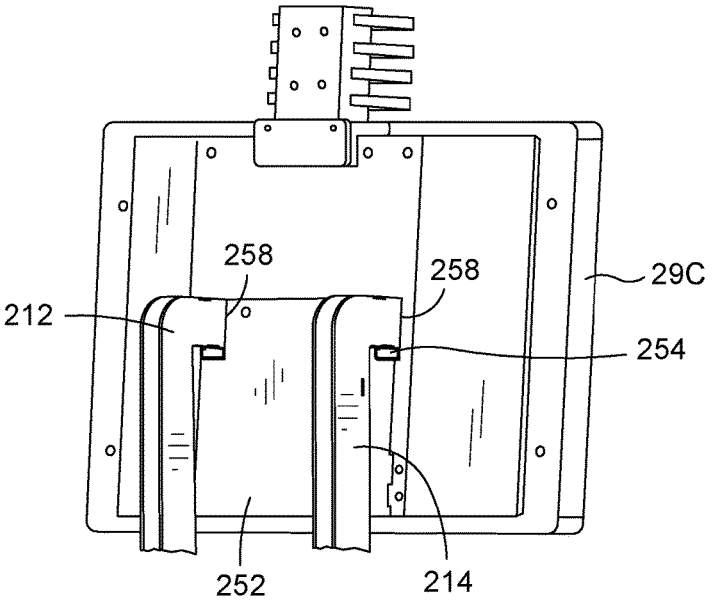
FIG. 6 illustrates the topper display mount illustrated in FIG. 5 as connected to a topper display.

FIG. 5 illustrates the upper portion 204 of the topper display mount 200 from two different perspectives. In one embodiment, as noted above, the upper portion 204 comprises one or more arms, such as spaced apart first and second arms 212,214. The arms 212,214 have a first or top end or portion and a second or bottom end or portion. The top end of the arms 212,214 support a topper display mounting plate 240. The mounting plate 240 may be generally planar and has a front face (on a side opposite the arms) which is configured to mount the topper display 28C (as seen in FIG. 6 but not illustrated in FIG. 5). The mounting plate 240 may have various shapes and sizes as well as mounting features, such as to connect or support a topper display in landscape or portrait orientation.

As illustrated in FIG. 5, the second or bottom end of each arm 212,214 may be configured as a pin or strut 242 which is configured to extend into one of the slots 220,222 of the tower 206 (as illustrated in FIG. 3). The arms 212,214 may extend generally vertically upward from the bottom portion thereof and then bend inwardly, such as at a 90-degree angle between the bottom and top portions. This allows the mounting plate 240 to be spaced outwardly from the main portion of the arms (e.g. in a vertical plane which is positioned forwardly of the main portion of the arms) and, as illustrated in FIG. 1, allowing the topper display 29C to be positioned forwardly in alignment with the first and second displays 28A,28B even though the topper display mount 200 is positioned behind the first and second displays 28A,28B.

In one embodiment, at least one of the arms 212,214, and preferably both arms, define a cable channel. In the illustrated embodiment, the cable channel is defined through at least a portion of each arm 212,214, such as from adjacent to the mounting plate 240 to the lower portion thereof. In one embodiment, this portion of the arms 212,214 comprises a main trough-shaped outer section (such as generally "C" or "U"-shaped in cross-section) and removable cover 244 which is located at an inside of each arm and which covers the trough in the other portion, thereby defining a relatively closed pathway through the arms. This permits one or more cables C (e.g. power, HDMI, DVI, etc.) to be run from the topper display 29C into a channel opening 248 near the top of the arm, through the covered cable channel defined by the arm, and out a bottom opening 250. From there, the one or more cables C can be routed into the cable channel 224 of the tower 206, as described above and illustrated in more detail in FIG. 3.

It will be appreciated that one or both arms 212,214 may define such a cable channel and that cables may be routed through one or both of such channels. Preferably, the arm(s) 212,214 define a cable channel from a point adjacent to the topper display 28C, such as at least inside an associated rear cover or facia 252 (as described in more detail below and illustrated in FIG. 6) to a point adjacent to or against the tower 206, so that the cable(s) C are generally enclosed and thus hidden from view and protected from damage, from the topper display 29C to the interior of the gaming machine cabinet 29C.

In one embodiment, at least one opening or aperture 256, and preferably a single aperture, may be defined in each arm 212,214 to provide cable routing access. For example, a single opening 256 may be provided in the cable routing cover 244 which is attached to the inside of each arm 212,214. The opening 256 may be defined between the top and bottom portions of the arm 212,214. The opening 256 may be used by a user to assist them in routing the one or more cables C through the arm(s) 212,214.

As just indicated, as illustrated in FIG. 6, the back of the topper display 29C is mounted to the front of the mounting plate 240 (which is not visible in FIG. 6 but is shown in FIG. 5). For example, one or more threaded fasteners may be passed through the mounting plate 240 from the back thereof into mounting holes in the back of the topper display 29C.

The facia or cover 252 is preferably then placed over the mounting plate 240 to cover it, as illustrated in both FIGS. 1 and 6. In one embodiment, the cover 252 defines first and second cut-outs or openings 258 for the arms 212,214. In one embodiment, the cover 252 may be configured to work with different sets of arms such as arms of different sizes and shapes (e.g. arms having different exterior dimensions in cross-section where they pass through the cut-outs), including the arms illustrated in FIG. 5, but also arms such as those illustrated in FIG. 8 and described below. Thus, in one embodiment, the arm openings or cutouts 258 may be sized to accept the largest dimensioned arms to be used therewith. Thus, smaller sized arms, such as the arms 212,214 illustrated in FIG. 5, may pass through the openings 258 and leave a gap. Thus, in one embodiment, a tab 254 may extend from each arm 212,214. For example, as illustrated in FIGS. 5 and 6, a tab 254 extends downwardly from each arm near the top thereof. The tabs 254 are sized, shaped and located so that when the cover 252 is mounted to the topper display 28C, the tabs 254 close or fill the remainder of the openings 258 which are not filled by the arms 212,214 themselves, creating a pleasing aesthetic appearance. Of course, the size, shape and location of the tabs 254 may depend upon the shape and size of the arms 212,214 and the size of the openings 258, as well as the location where the arms 212,214 are designed to pass through those openings 258 (for example, in this configuration, the tabs 254 extend downwardly, but they could extend upwardly, to one or both sides, etc., depending upon the variations noted).

Figure 7:
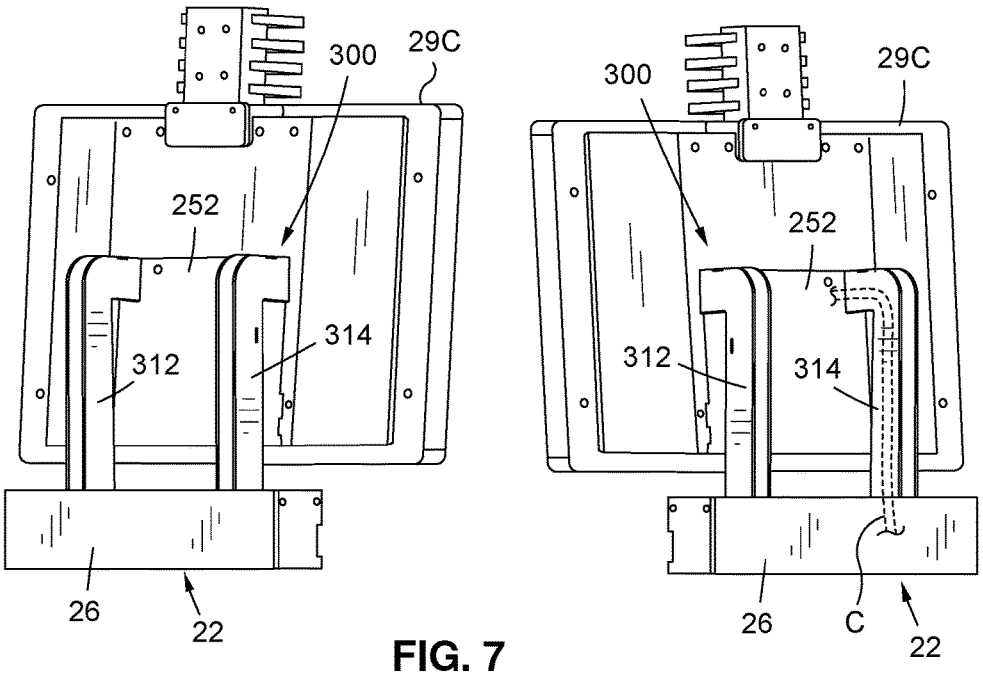
FIG. 7 illustrates the topper display mount of FIGS. 5 and 6 as attached to a gaming machine.
Figure 8:
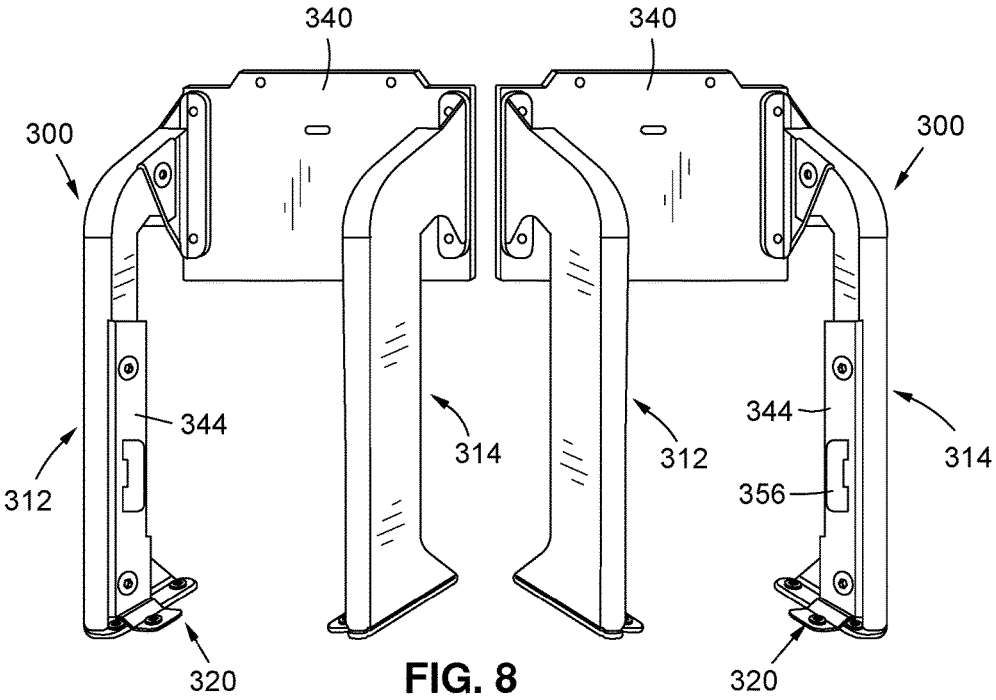
FIG. 8 illustrates aspects of a topper display mount in accordance with a second embodiment of the invention.

FIGS. 7 and 8 illustrate a second embodiment topper display mount 300 in accordance with the invention. In this embodiment, the topper display mount 300 does not include any base or bottom portion, but is instead configured with only an upper portion which mounts directly to the top of the cabinet 26 of the gaming machine 22. Such a configuration might be utilized, for example, where the gaming machine only includes a single main display 28A and the topper display 29C then comprises a secondary display.

FIG. 8 illustrates the topper display mount 300 in two different perspectives. This configuration topper display mount 300 is similar to the upper portion 204 of the topper display mount 200 illustrated in FIG. 5, and as such, all of the features thereof will not be described again in full detail.

In general, this embodiment topper display mount 300 includes first and second arms 312,314 which support at their tops ends a topper display mounting plate 340. Once again one, and preferably both arms 312,314, define a cable channel therethrough, such as via a main portion of each arm along with a cable cover 344. The cable cover 344 may again define a cable access opening 356. In this embodiment, as illustrated in FIG. 7, one or more cables C may be routed through one or both arms 312,314 from the topper display 29C through the arms into aligning openings in the cabinet 26 and then into the interior of the cabinet.

A key difference with this embodiment is that the arms 312,314 mount to the top of the gaming machine cabinet 26 or another generally planar mounting surface, rather than a tower or the like as in the prior embodiment. As such, the lower or bottom portion of each arm 312,314 does not include a strut which is designed to slip into a slot. Instead, the bottom of each arm 312,314 may be configured as a foot 320, such as defining one or more flanges through which one or more fasteners may be passed to directly mount the arm 312,314 to the cabinet 26.

In this embodiment, the arms 312,314 are larger in dimension than the ones illustrated in FIG. 5 and as such, using the same cover 252 as before, the arms do not need to include tabs or the like (because the arms fit tightly to the dimensions of the openings in the cover 252).

Figure 9:
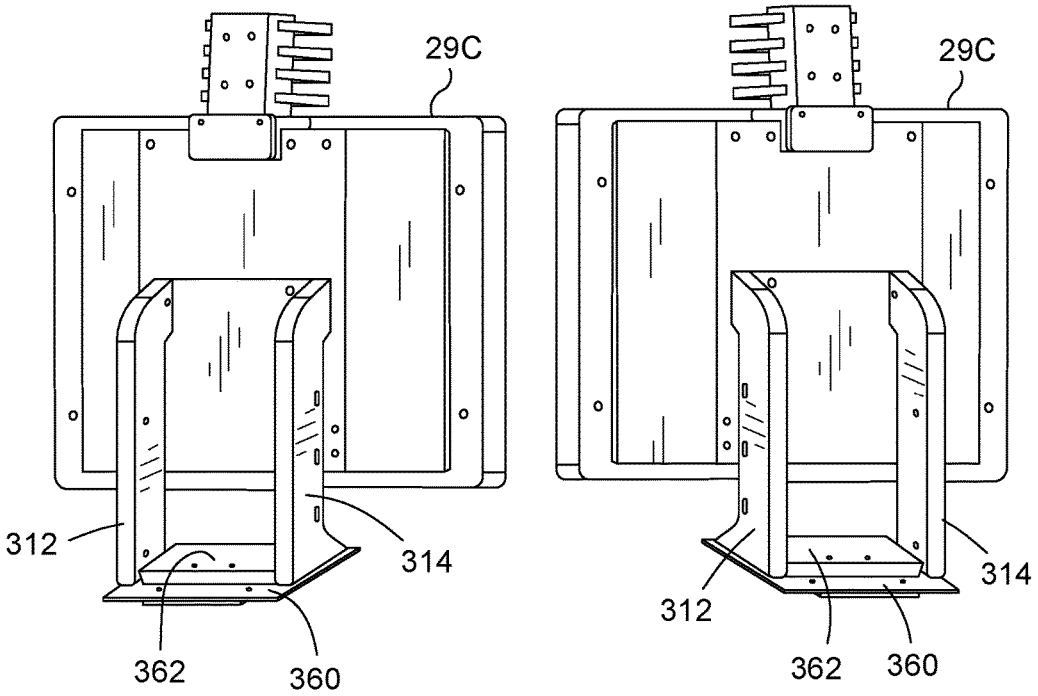
FIG. 9 illustrates a mounting bracket for the topper display mount illustrated in FIG. 8.

As illustrated in FIG. 9, in one embodiment, the arms 312,314 may be mounted to a base plate 360 which is in turn mounted to an associated cabinet 26. Also, whether such a plate 360 is used, a filler or cover 362 may be positioned between the arms 312,314 at their bottom ends to cover the mounting flanges and mounting hardware, etc.

It will be appreciated that the above-described features may be applied to gaming machines having various configurations. For example, although not illustrated in the figures, in one embodiment, instead of having the topper display 28C be mounted to the top of a gaming machine main cabinet 26 via the topper display mount 300 just described, the topper display 28C could be mounted on a cabinet or stand which is located directly behind the gaming machine main cabinet 26 and which thus allows the topper display 28C to be positioned adjacent to the display(s) which are supported by the main cabinet. It is also possible for a topper display mount of the invention to be connected to or associated with a top box to which a secondary display is already mounted, such as above the main gaming machine cabinet.

Of course, the length of the arms (212,214 and 312,314) and the height of the tower of the topper display mounts of the invention may have various sized and shaped, including lengths. Preferably, the dimensions of the arms (and tower, in embodiments including such) are selected based upon the configuration of the gaming machine so as to cause the topper display 28C to be correctly positioned. In a preferred embodiment, this position is one where the topper display 28C is in the same plane as one or more of the other displays (such as the display to which is it most adjacent), and is preferably positioned directly adjacent to or against one of the other displays, so as to create a generally seamless video presentation.

Figure 10:
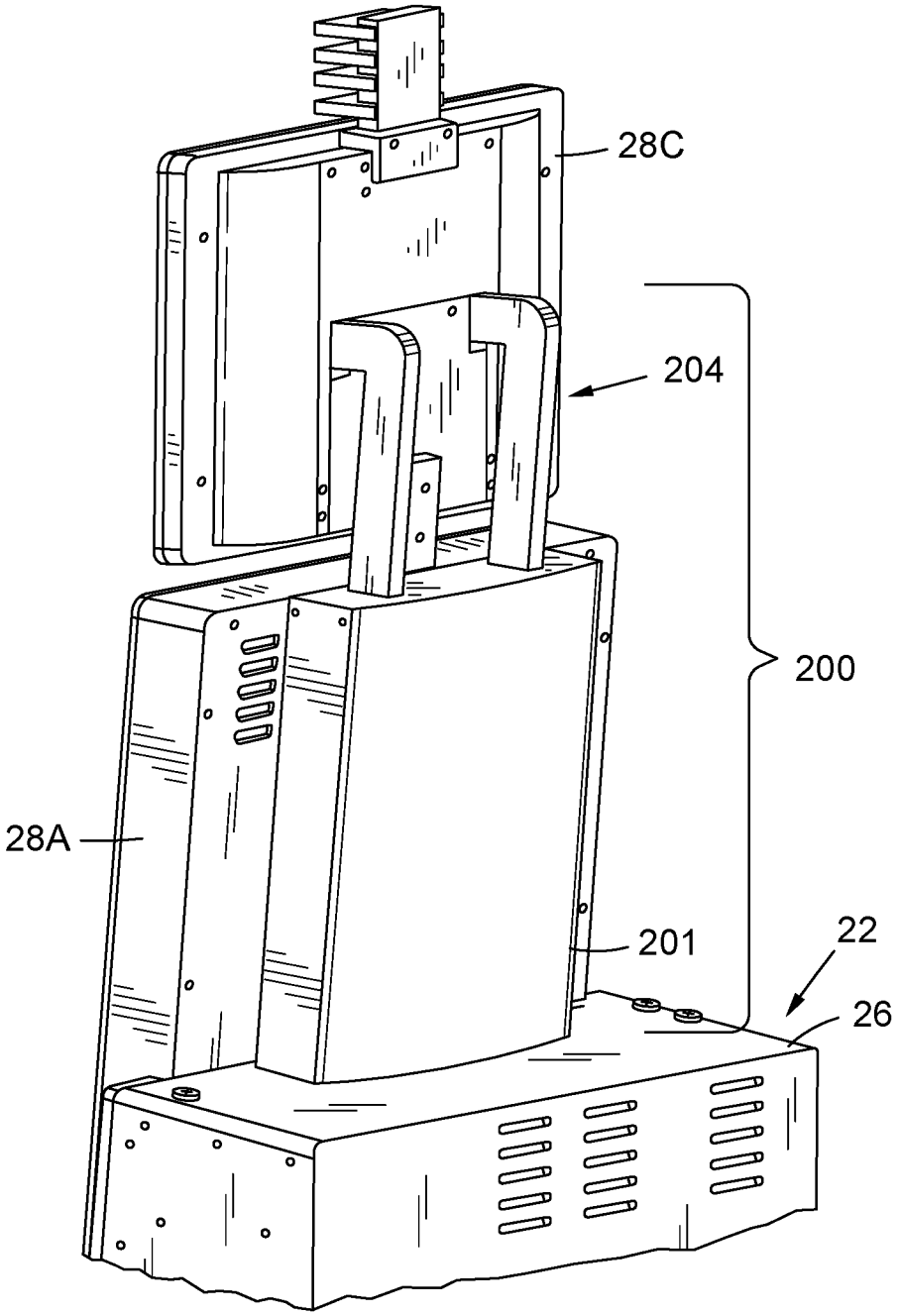
FIG. 10 illustrates another embodiment of a gaming machine having a topper display mount and associated topper display in accordance with the invention.

In the example illustrated in FIG. 1 and described above, the gaming machine has a main display 28A, a secondary display 28B and the topper display 29C. As noted above, however, the topper display mount may be utilized with gaming machines having different configurations. For example, as illustrated in FIG. 10, the topper display mount 200 might be utilized relative to a gaming machine 22 having a cabinet 22 which supports a single main display 28A. In this embodiment, the main display 28A is a generally rectangular display which is positioned in portrait orientation. The top of the main display 28A thus extends upwardly above the top of the gaming machine cabinet 26. The topper mount 200, which is similar to the topper mount described above and illustrated in FIGS. 2-7 (and thus includes an upper portion 204 which extends from a tower (not visible) which is positioned behind a facia 201), supports the topper display 28C above the cabinet 26 and the top of the main display 28A.

It will be appreciated that features of the invention may be altered or modified without deviating from the scope of the invention. For example, while certain fasteners have been described for use in connecting various components of the invention, other types of connectors might be used and in some cases, components might be formed or combined into a single element. Also, the materials from which components of the invention are constructed may vary. For example, the supports and arms may be constructed from metal or the like to provide high strength. However, the cover panels and the like might be constructed from plastic or the like. Of course, the various components might be painted, colored or the like, for aesthetic appeal.

In one embodiment, fasteners or other connectors and their locations, may be chosen to facilitate the utility of the topper mount. For example, the location of the cable cover fasteners or the type of those fasteners, is preferably chosen to reduce interference with the routing of cabling through the cable channels.

Various features and advantages or the invention will now be described. One aspect of the invention is a display or monitor mount for a gaming machine. Preferably, the mount is a topper display mount—e.g. a mount for supporting a video (or other) display at the top of the gaming machine, such as above the main cabinet and/or one or more secondary displays which are positioned at the top of the cabinet.

As one aspect of the invention, the bulky box topper configuration of the prior art is eliminated. The topper display is no longer mounted in or to such a box or housing, but is instead supported by a thin rear support structure, where the topper display is essentially cantilevered from the front of that structure.

In one embodiment, the topper display mount may include base and upper portions which allow the topper display to be positioned in a high vertical position without compromising the strength of the mounting. In another embedment, the topper display mount may extend directly from a cabinet or other base structure.

In all embodiments, the topper display mount is relatively thin and streamlined. As one aspect of the invention, the topper display mount defines a cable routing channel or path therethrough from the topper display to the associated cabinet or other base structure, thus hiding the cable(s) from view and keeping them protected from damage.

Another aspect of the invention is the ability to use a single video display topper mount cover with mounts having arms of different sizes, where the cover and the arms cooperate to define an enclosure which covers the topper display mounting plate and associated hardware from view, creating an aesthetically pleasing appearance.

This mounting configuration maintains the topper display in position and prevents movement during assembly, shipment, installation and movement of the gaming machine, while still maintaining ease of serviceability and re-installation.

The topper mount also allows the topper display to be positioned in alignment with other displays of the gaming machine, such as in the same vertical plane. Most preferably, the topper mount is positioned in the same vertical plane as the display to which it is adjacent (or is mounted at a desirable cooperating angle thereto, such as tilting slightly inward or downward towards the player). Also, the topper mount allows the topper display to be mounted to that it is directly adjacent to another display. Preferably, a bottom portion of the topper display is mounted adjacent to a top portion of the adjacent display. In embodiment, the topper display and the adjacent display may touch or abut, or be separately only by one or more bezels, trims, light rings or the like, or a very small gap (such as less than 0.5 inches and more preferably less than 0.25 inches). In this manner, the topper mount essentially forms a seamless video display with the adjacent display, making it easy for the player to view content displayed by those displays at the same time without having to shift focus.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a cabinet defining at least one interior space a first video display located at a front of said cabinet;

at least one player input device;

a memory device;

a controller;

machine-readable code stored in said memory device and executable by said controller to present one or more wagering games comprising a display of game information via said first video display;

a topper display mount, said topper display mount comprising a tower and a first arm and a second arm, said tower having a bottom and a top, said bottom connected to said cabinet, and a bottom of said first and second arms connected to a top of said tower and extending upwardly therefrom; and a topper video display, said topper video display connected to said first and second arms, whereby said topper video display is located above said first video display;

wherein at least one of said first and second arms defines a generally enclosed first cable routing channel having an opening at a top of said arm and an opening at a bottom of said arm, said opening at said bottom of said arm positioned adjacent to a second cable routing channel defined by said tower from a top to a bottom thereof, said second cable routing channel positioned between two mounting bracket portions of said tower.

2. The gaming machine in accordance with claim 1 further comprising a mounting plate supported by said arm at a top of said first and second arms, said topper video display connected to said mounting plate.

3. The gaming machine in accordance with claim 2 wherein a cover is positioned over said mounting plate and a top end of said first arm extends through a first cut-out in said cover and a top end of said second arm extends through a second cut-out in said cover.

4. The gaming machine in accordance with claim 3 wherein said first arm comprises an outwardly extending tab which covers a portion of said first cut-out not occupied by said first arm and second arm comprises an outwardly extending tab which covers a portion of said second cut-out not occupied by said second arm.

5. The gaming machine in accordance with claim 1 wherein said first cable routing channel is defined by a first arm portion having a cover mounted thereto.

6. The gaming machine in accordance with claim 5 wherein at least one cable routing aperture is provided in said cover.

7. The gaming machine in accordance with claim 1 further comprising at least one cable extending from said topper video display through said first cable routing channel, said second cable routing channel and through an opening in said cabinet into said interior space.

8. The gaming machine in accordance with claim 1 wherein said tower is located inside a removable facia.

9. The gaming machine in accordance with claim 1 wherein a bottom of said topper video display is positioned against a top of said first video display.

10. The gaming machine in accordance with claim 1 further comprising a second video display positioned above said first video display, wherein said topper video display is positioned above said second video display and in a same vertical plane as said second video display.

11. The gaming machine in accordance with claim 10 wherein a bottom of said topper video display is positioned against a top of said second video display.

12. The gaming machine in accordance with claim 1 wherein said topper video display faces a front of said gaming machine and said topper display mounted is located behind said topper video display.

13. The gaming machine in accordance with claim 1 wherein a top end of said first and second arms extends at an angle of 90 degrees relative to said bottom end of said first and second arms.

* * * * *